United States Patent [19]

Mai

[11] Patent Number: 5,054,218

[45] Date of Patent: Oct. 8, 1991

[54] STEAM IRONING DEVICE HAVING ROTATABLE PAIRS OF IRONING BARS, A SLIDE BOX, AND A STEAM IRON FOR IRONING GARMENTS MOUNTED ON THE BARS

[75] Inventor: Dieter Mai, Walleshausen, Fed. Rep. of Germany

[73] Assignee: Veit GmbH & Co., Landsberg/Lech, Fed. Rep. of Germany

[21] Appl. No.: 583,016

[22] Filed: Sep. 14, 1990

Related U.S. Application Data

[62] Division of Ser. No. 359,392, May 31, 1989, Pat. No. 4,964,230.

[30] Foreign Application Priority Data

Jun. 3, 1988 [DE] Fed. Rep. of Germany ..... 3818898

[51] Int. Cl.[5] ..... D06F 71/18; D06F 71/28; D06F 71/30

[52] U.S. Cl. ..... 38/1 B; 38/16; 38/28; 38/30; 38/79; 223/37; 223/51

[58] Field of Search ..... 38/1 B, 14, 16, 25–30, 38/32, 79, 104, 106; 112/217, 217.1; 223/60, 70, 72, 73, 51, 52.5, 57, 75, 76

[56] References Cited

U.S. PATENT DOCUMENTS

| | | | |
|---|---|---|---|
| Re. 30,017 | 6/1979 | Bullock et al. | 38/1 B |
| 1,423,068 | 7/1922 | Baker | 38/28 |
| 1,611,157 | 12/1926 | Bricker et al. | 38/1 B |
| 1,649,456 | 11/1927 | Ellis et al. | 38/1 B |
| 1,699,458 | 1/1929 | Tol | 38/28 |
| 2,108,372 | 2/1938 | Fulps | 223/57 |
| 2,245,184 | 6/1941 | Crocella | 38/30 |
| 2,832,159 | 4/1958 | Frick | 38/30 |
| 3,107,447 | 10/1963 | Tucci | 38/1 B |
| 3,366,292 | 1/1968 | Thompson | 38/16 X |
| 3,865,285 | 2/1975 | McCormack et al. | 38/1 B X |
| 3,964,185 | 6/1976 | Bullock et al. | 38/1 B X |
| 3,990,163 | 11/1976 | Aulich et al. | 38/1 B |
| 4,223,816 | 9/1980 | Glover | 223/57 X |
| 4,817,308 | 4/1989 | Fend et al. | 38/1 B |
| 4,964,230 | 10/1990 | Mai | 38/1 B |

FOREIGN PATENT DOCUMENTS

| | | | |
|---|---|---|---|
| 285448 | 3/1928 | United Kingdom | 38/28 |

*Primary Examiner*—Werner H. Schroeder
*Assistant Examiner*—Ismael Izaguirre
*Attorney, Agent, or Firm*—Kenyon & Kenyon

[57] ABSTRACT

An ironing apparatus has a plurality of pairs of ironing bars mounted on a rotatable plate. The ironing bars are attached to a plurality of air distribution boxes which are attached to the plate, and each bar has a controlled suction work surface for holding a fabric part thereon. Two guide rails are mounted above the work surface and a slide box is coupled to the guide rails for sliding thereon. A steam iron is adjustably suspended from the slide box for ironing the seam of the fabric part. The guide rails are journaled to a pair of guide rods axially oriented substantially perpendicular thereto. The steam iron is moved along the path of the seam by moving the slide box on the guide rails, and by moving the guide rails on the guide rods.

7 Claims, 4 Drawing Sheets

STEAM IRONING DEVICE HAVING ROTATABLE PAIRS OF IRONING BARS, A SLIDE BOX, AND A STEAM IRON FOR IRONING GARMENTS MOUNTED ON THE BARS

This application is a division of application Ser. No. 07/359,392, filed May 31, 1989, now U.S. Pat. No. 4,964,230, issued on Oct. 23, 1990.

FIELD OF THE INVENTION

The present invention relates to ironing apparatus and, in particular, to ironing apparatus for ironing the seams of fabric parts or garments.

BACKGROUND INFORMATION

In garment making the ironing of seams in fabric parts by hand is extremely time-consuming and, therefore, expensive. Therefore, some known ironing apparatus provide a means for at least partially automating seam ironing processes. In some such apparatus, the fabric part to be ironed is fitted between two bars and the seam is ironed by a pressing operation under the application of heat and steam.

Known seam ironing apparatus are shown, for example, in German patents DE 36 32 839 and DE 35 35 837 A1. Such apparatus are employed generally to reduce the time in making the fabric garment. Known apparatus have generally proven to be satisfactory in ironing fabric parts or garments having linear seams. However, most known ironing apparatus have proven to be difficult to use in ironing seams that are curved, or that follow a bump or depression in the fabric part or garment.

Because the seams in most fabric parts or garments are not completely linear, but often have at least some curved portion, known ironing apparatus have not provided a satisfactory solution to the problem of efficiently ironing seams in the garment industry. It is an object of the present invention therefore to overcome the problems, drawbacks and disadvantages of known seam ironing apparatus.

SUMMARY OF THE INVENTION

The present invention is directed to an ironing apparatus for ironing fabric parts. The apparatus comprises a frame and a work table mounted on the frame. The work table is dimensioned so as to place a fabric part thereon. At least one guide rail of the apparatus is mounted to the frame above the work table. The apparatus further comprises a slide box coupled to the guide rail for moving relative to the guide rail. A steam iron of the apparatus is adjustably suspended from the slide box above the work table for ironing a fabric part placed thereon.

In one embodiment of the present invention, the apparatus further comprises slide box drive means and guide rail drive means. The slide box drive means comprises at least one first drive belt drivingly connected to the slide box for moving the slide box on the guide rail. The slide box drive means further comprises at least two drive pulleys rotatably mounted to the frame. The first drive belt is mounted over the pulleys so that by rotating the drive pulleys, the drive belt rotates and, in turn, drives the slide box on the guide rail. The slide box drive means preferably includes a drive motor drivingly coupled to at least one of the drive pulleys for rotating the drive pulley to move the slide box on the guide rail.

In another embodiment of the present invention, the ironing apparatus further comprises at least one guide rod mounted to the frame above the work table. The guide rod is axially oriented substantially perpendicular to the guide rail. The guide rail is journaled to the guide rod for moving the guide rail on the guide rod over the work table. Preferably, the apparatus further includes guide rail drive means for driving the guide rail on the guide rod over the work table. The guide rail drive means comprises at least one second drive belt drivingly coupled to the guide rail for moving the guide rail on the guide rod. The guide rail drive means further includes at least two drive pulleys rotatably mounted to the frame. The second drive belt is mounted over the drive pulleys so that upon rotation of the drive pulleys, the second drive belt drives the guide rail on the guide rod over the work table.

In another embodiment of the present invention, the ironing apparatus further comprises suspension means for suspending the steam iron from the slide box and for adjustably positioning the steam iron relative to the work table. The suspension means comprises a center frame for suspending the steam iron therefrom. A lifting plate of the suspension means is coupled to the other end of the center frame for vertically adjusting the center frame relative to the work table. The suspension means further comprises at least one lifting lever. The lifting lever is pivotally mounted on one end to the lifting plate and is pivotally mounted on another end to the slide box. When the lifting lever is pivoted about its end mounted to the slide box, the lifting plate and center frame and, therefore, the steam iron suspended therefrom are vertically adjusted relative to the work table. Preferably, the suspension means comprises two lifting levers mounted in parallel relationship to each other. One end of each of the lifting levers is pivotally mounted to the slide box, and another end of each of the lifting levers is pivotally mounted to the lifting plate. When the lifting levers are pivotted about their ends mounted to the slide box, the lifting plate and center frame and, therefore, the steam iron suspended therefrom are vertically adjusted relative to the work table.

In another embodiment of the present invention, each suspension means of the ironing apparatus further comprises at least one rocking lever. The rocking lever is pivotally mounted near one end thereof to the center frame. The suspension means further includes at least one mounting member mounted to the steam iron adjacent to the rocking lever. The mounting member is supported on an inside surface of the free end of the rocking lever, so that when the rocking lever is pivotted relative to the center frame, the mounting member slides under the weight of the steam iron relative to the rocking lever for adjusting the position of the steam iron.

In another embodiment of the present invention, an ironing apparatus comprises a frame and a rotatably driven plate mounted to the frame. At least two axially elongated ironing bars of the apparatus are each mounted on one end thereof to the plate and project outwardly therefrom. At least one guide rail of the apparatus is mounted on one end thereof to the frame and projects outwardly therefrom above the two ironing bars. The ironing apparatus further includes at least one slide box. The slide box is coupled to the guide rail and moveable in relation thereto. At least one ironing member of the apparatus is adjustably suspended from the slide box for ironing a fabric part placed on at least one of the ironing bars.

In another embodiment of the present invention, the ironing apparatus further comprises suction means mounted to the apparatus for sucking air through at least one of the ironing bars for holding a fabric part in place thereon. Preferably, the apparatus comprises at least four ironing bars, wherein each of the ironing bars are mounted on one end thereof to the plate and project outwardly therefrom, and are spaced substantially equally apart thereon. The suction means of the apparatus preferably comprises a blower, in fluid communication with at least one of the ironing bars for sucking air therethrough.

In another embodiment of the present invention, the apparatus further comprises at least four air pipes. Each of the air pipes are rotatably mounted on one end to the cover plate and are each coupled on the other end to one of the ironing bars, respectively, for supporting the ironing bars on the cover plate. Preferably, the apparatus of the present invention further includes at least four air distribution boxes. Each of the air distribution boxes is mounted on one side thereof to the other end of each of the respective air pipes. Each air distribution box further defines on one side thereof an aperture for mounting therein at least one of the ironing bars.

In another embodiment of the present invention, the ironing apparatus comprises eight ironing bars, wherein each of the air distribution boxes has mounted in its respective aperture therein one pair of ironing bars. The apparatus further includes positioning means coupled to each of the ironing bars for rotating the ironing bars upon rotation of the plate, for controlling the orientation of the surfaces of the ironing bars. The positioning means preferably includes at least four gear members, each of the gear members being mounted respectively to one of the air pipes. The positioning means also includes a chain coupled to the four gear members for rotating the gear members and, therefore, the respective air pipes for controlling the orientation of the respective ironing bars.

One advantage of the apparatus of the present invention is that the path of the steam iron can be controlled to follow the path of a curved seam. Likewise, if the seam has a bump or elevation, or, on the other hand, a depression therein, the pivotally mounted steam iron will ordinarily substantially adapt to that contour to thoroughly iron the seam. Another advantage of the apparatus of the present invention is that the embodiment comprising a plurality of ironing bars can consecutively iron a large number of garments at a substantial time savings and, therefore, cost savings over known apparatus.

Other advantages of the present invention will become apparent in view of the following detailed description and drawings taken in connection therewith.

DESCRIPTION OF THE PREFERRED EMBODIMENTS

Figure 1:
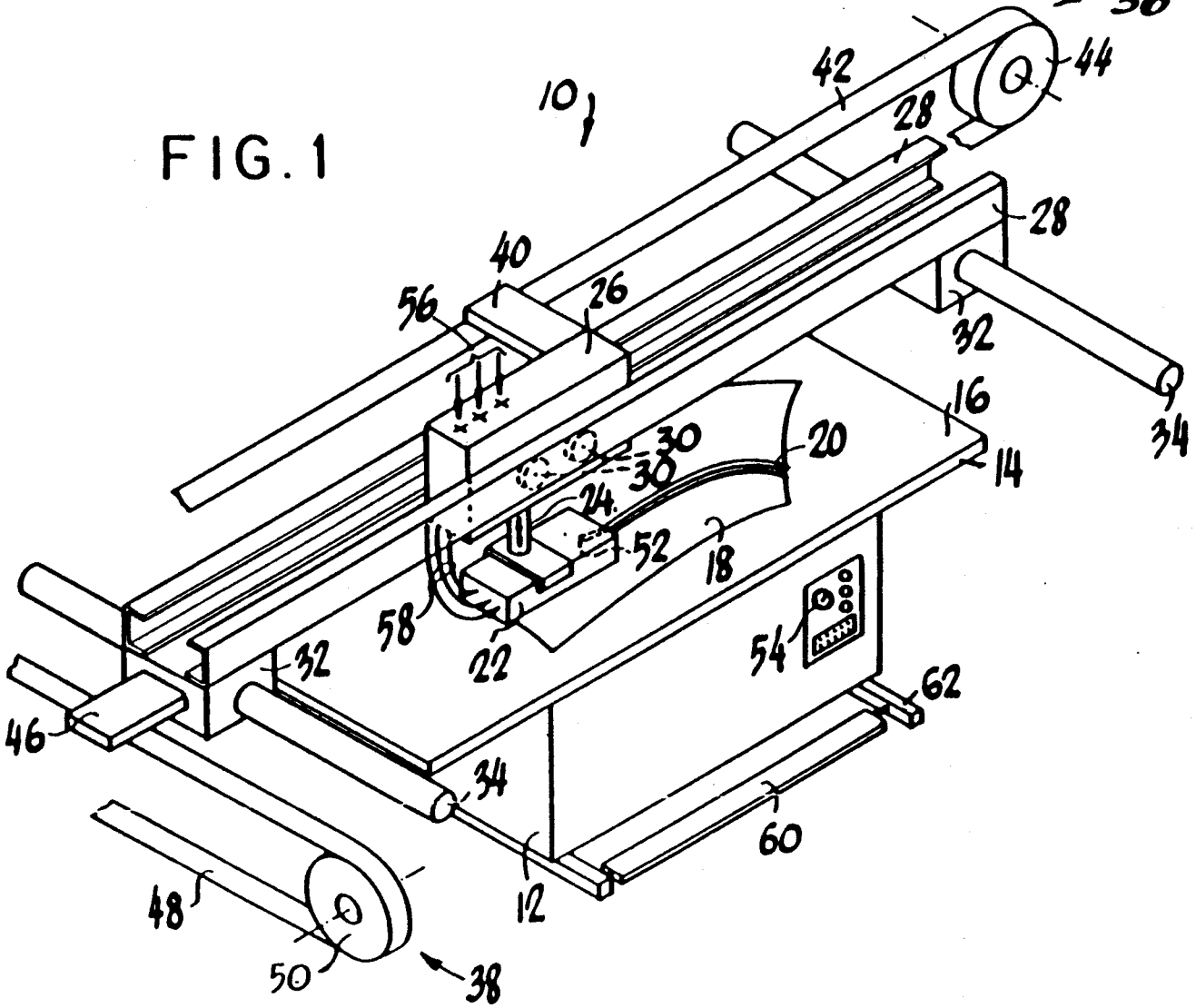
FIG. 1 is a perspective view illustrating schematically a seam ironing apparatus embodying the present invention.

In FIG. 1, a seam ironing apparatus embodying the invention is indicated generally by the reference numeral 10. The apparatus 10 comprises a stand 12 and a work table 14 mounted on top thereof. Preferably, the work table 14 is removable from the stand 14 and may be replaced by another work table having a different size and/or shape depending upon the type of fabric part or garment to be ironed. The work table 14 has a work surface 16 which is a controlled suction surface of a type known to those skilled in the art. The work surface 16 preferably has formed therein a plurality of apertures (not shown) which are connected in fluid communication with a blower (not shown) for sucking air through the apertures in order to hold the fabric part 18 in place on the work surface. A fabric part indicated generally as 18, having a seam 20 therein to be ironed is placed on top of the work surface 16. When ironing the seam 20, air is sucked or drawn through and/or across the work surface 16 in order to hold the fabric part 18 in place thereon.

The apparatus 10 further comprises a steam iron, indicated generally as 22, mounted above the work surface 16. The steam iron 22 is suspended from a height-adjustable suspension, indicated generally as 24, of the apparatus 10. The apparatus 10 further includes a slide box 26 slideably mounted on a pair of guide rails 28,28 by two pairs of rollers 30,30. Although only one pair of rollers 30,30 is shown, each pair of rollers is rotatably mounted on either side of the slide box 26. The suspension 24 is mounted inside the slide box 26 for controlling the positioning of the steam iron 22 over the fabric part 18, as will be described further below. Each guide rail 28,28 is mounted on either end thereof to a guide member 32,32 of the apparatus 10. The guide rails 28,28 are mounted on the guide members 32,32 parallel to each other and are spaced a sufficient distance apart in order to mount the slide box 26 therebetween. The guide members 32,32 are each journaled over a guide rod 34, 34, respectively. The guide rods 34,34 are each, in turn, mounted to a frame (not shown) along an axis substantially perpendicular to the axis of the guide rails 28, 28. The steam iron 22, therefore, can be positioned in a horizontal plane over the fabric part 18 as desired by moving the slide box 26 on the rails 28,28, and by moving the rails 28,28 on the guide rods 34,34. Likewise, the steam iron 22 can be positioned vertically in relation to the work surface 16 and fabric part 18 by adjusting the suspension 24, as will be described in further detail below.

The apparatus 10 further comprises a slide box drive, indicated generally as 36, and a guide rail drive, indicated generally as 38. The slide box drive 36 includes a connecting member 40 mounted on one side of the slide box 26 which, in turn, is connected to a first drive belt 42. The first drive belt 42 is rotatably mounted on a pair of first drive pulleys 44,44 (only one shown). One of the first drive pulleys 44,44 is rotatably driven by a drive motor (not shown) for driving the slide box 26 over the guide rails 28,28. The guide rail drive 38 comprises a connecting member 46 mounted on one side of one of the guide members 32,32, and a second drive belt 48 is rotatably mounted on a pair of second drive pulleys 50,50 (only one shown). The second drive belt 48 is connected to the connecting member 46, and one of the second drive pulleys 50,50 is driven by a motor (not shown) for rotating the drive belt 48 and, in turn, moving the guide rails 28, 28 over the guide rods 34,34.

Figure 2:
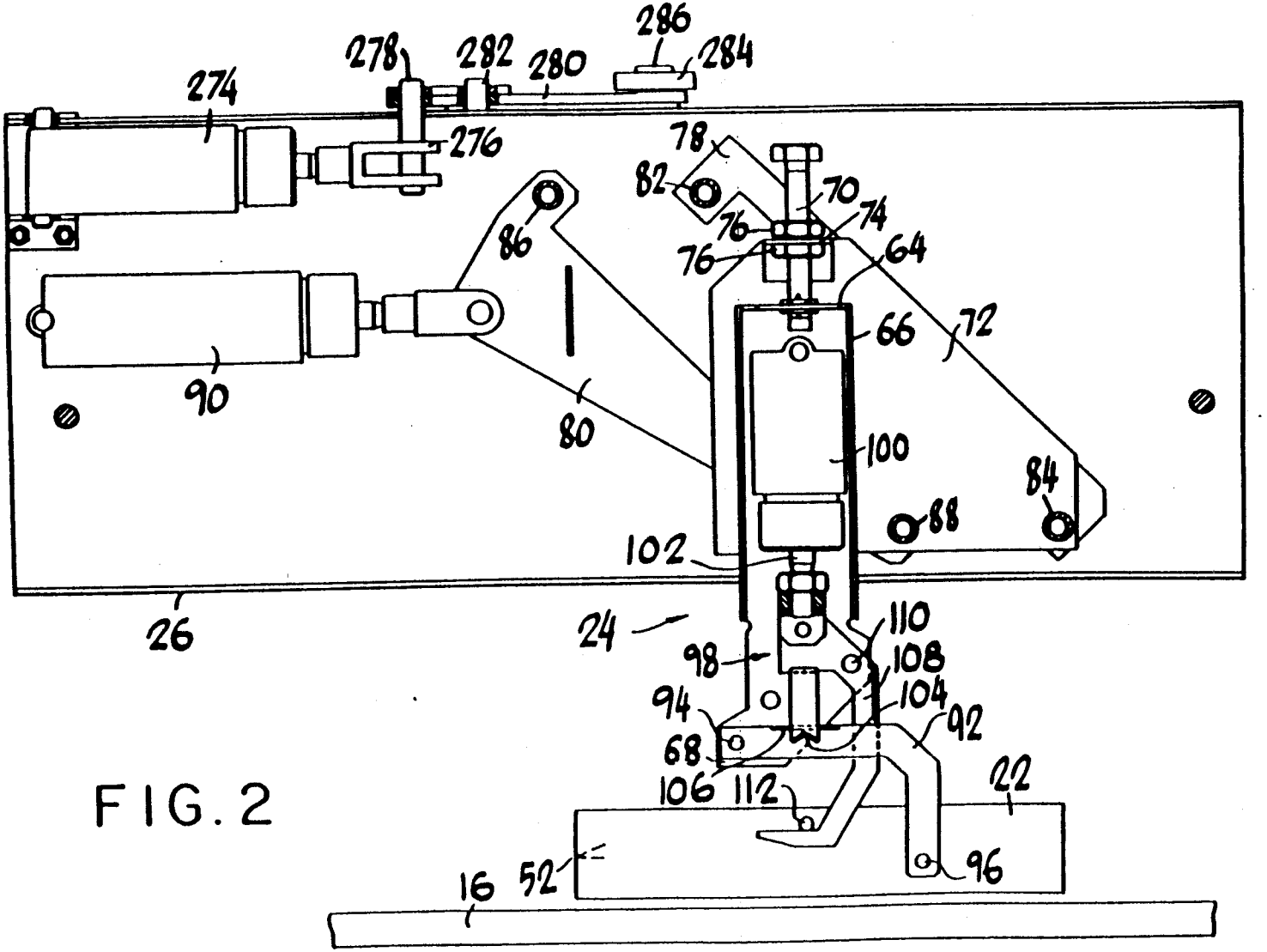
FIG. 2 is a schematic front planar view of part of the apparatus of FIG. 1, and also part of the apparatus of FIG. 3, illustrating in further detail the slide box, suspension, and steam iron of the apparatus.

The steam iron 22 comprises a blow nozzle 52, illustrated in phantom in FIGS. 1 and 2, mounted in the front end thereof and which is connected to valves (not shown), in a manner known to those skilled in the art, for blowing air and/or steam therethrough and onto the fabric part 18 and/or seam 20 thereof. As shown in FIG. 1, the blow nozzle 52 is directed downwardly toward the work surface 16 at an oblique angle, for directing the air and/or steam onto the fabric part 18 in order to facilitate uniformly ironing the seam 20.

The apparatus 10 further comprises a control unit 54 of a type known to those skilled in the art for controlling the drive motors (not shown) for driving the first and second drive pulleys 44,44 and 50,50, respectively, and for controlling the suspension 24. Likewise, the control unit 54 is preferably connected to the blower (not shown) for sucking air through and/or across the work surface 16 and for controlling the operation of the steam iron 22, including the operation of the valves (not shown) controlling the blow nozzle 52 therein. Therefore, the control unit 54 can be employed to control both the position and operation of the steam iron 22 over the fabric part 18, and the suction of the work surface 16 to hold the position of the fabric part 18 thereon. Preferably, the control unit 54 is programmably controllable, in a manner known to those skilled in the art, for controlling a sequence of operations of the steam iron 22 when, for example, consecutively ironing a particular type of fabric part, as will be described in further detail below.

The apparatus 10 further comprises control lines of a type known to those skilled in the art, indicated generally as 56, and shown simply as crosses and arrows in FIG. 1. The control lines 56 are connected through the slide box 26 and are provided for carrying electric current, steam and/or pressurized air to the components of the slide box 26 and steam iron 22. Additional control lines of the apparatus, indicated generally as 58, which may be the same as the control lines 56, are connected between the slide box 26 and steam iron 22 for carrying electric current, steam and/or pressurized air from the control lines 56 in the slide box to the components of the steam iron 22. The apparatus 10 further comprises a control pedal 60 electrically connected to the control box 54 in a manner known to the those skilled in the art. The pedal 60 is pivotally mounted to a frame 62 of the apparatus 10 and is depressible for controlling, for example, the starting and stopping of the control unit 54. Therefore, an operator can use his or her hands to position the fabric part 18 on the work surface 16, while starting the control unit 54 with the pedal 60. The control unit 54, in turn, can be preprogrammed to position and operate the steam iron 22 as required to iron the particular fabric part 18 and seam 20.

In operating the apparatus 10 to iron a seam, such as the seam 20, first the slide box 26 and steam iron 22 are moved to one side of the work table 14 away from the area where the fabric part 18 is to be located. The fabric part 18 is then placed on the work surface 16 without any folds, at least in the area of the seam 20. The operator then depresses the pedal 60 which, in turn, signals to the control box 54 to operate the blower (not shown) to control the suction through the work surface 16.

The suction on the work surface 16 holds the fabric part 18 in place. The edges of the fabric part 18 adjacent to the seam 20 are then folded outwardly, away from the center of the seam 18. Depending upon the thickness of the fabric part 18, and the force of the suction through the work surface 16, the suction through the work surface may facilitate the folding of the fabric edges outwardly along the seam. The steam iron 22 is then moved over the fabric part 18 along the curve of the seam 20, preferably immediately above the seam 20, by adjusting the suspension 24, and by controlling the first and second drive belts 42 and 48, respectively. Before the steam iron 22 is moved over the seam 20, it is positioned so that the blow nozzle 52 is directed toward the seam. The control unit 54 is then operated to actuate the valves (not shown) of the blow nozzle 52. The pressurized air and/or steam flowing from the nozzle 52 thus facilitates spreading the edges of the fabric part adjacent to the seam outwardly. Once the steam iron 22 reaches the other end of the seam 20, the edges of the fabric part adjacent to the seam are ordinarily spread apart and downwardly. The control unit 54 operates the suspension 24 to lower the steam iron 22 so that the bottom surface thereof rests against the seam 20. The steam iron 22 is then moved under the control of the control unit 54 back over the length of the seam 20 to iron the seam.

Upon reaching the other end of the seam 20, the steam iron 22 is again raised under the operation of the control unit 54, by adjusting the suspension 24 so that the steam iron is positioned immediately above the work surface 16. The fabric part 18, in which the seam 20 has been ironed, may then be removed from the work table 14 and another fabric part may be placed thereon and ironed in the same manner as described above. As can be seen, the control unit 54 may be programmably controlled to operate the steam iron 22 to repetitively iron the same type of fabric parts or garments, at a substantial savings in time and expense over known methods and apparatus.

Turning to FIG. 2, the steam iron 22, suspension 24, and slide box 26 are shown in further detail. The suspension 24 comprises a U-frame, indicted generally as 64, which includes an elongated center member 66. The center member 66 has formed on one end thereof a pair of legs 68, 68 extending outwardly and downwardly from either side thereof. The legs 68,68 thus give the U-frame 64 a generally U-shape. An adjustable bolt 70 of the suspension 24 is rotatably mounted through the other end of the center member 66. The suspension 24 further includes a lifting plate 72 having a lip 74 on one side thereof, that projects inwardly in a plane substantially parallel to the plane of the work surface 16. The lifting plate 72 thus is mounted to the end of the center member 66 by means of the bolt 70, which is threadedly engaged through the lip 74. A pair of locknuts 76,76 of the suspension 24 are threaded to the bolt 70 on either side of the lip 74. The locknuts 76,76 may be tightened against the lip 74 to lock the position of the bolt 70 and, therefore, the center member 66 in relation thereto.

The slide box 26 further includes a first lever 78 and a second lever 80, both mounted in parallel relationship to each other. The first lever 78 is pivotally mounted by a first pin 82 on one end to a side wall of the slide box 26. The other end of the first lever 78 is pivotally mounted to the lifting plate 72 by a second pin 84. Likewise, the second lever 80 is pivotally mounted on one end to a side wall of the slide box 26 by a third pin 86, and is pivotally mounted on the other end to the lifting plate 72 by a fourth pin 88. As can be seen, the suspension 24 and, therefore, the steam iron 22 is vertically adjustable in relation to the work surface 16 by rotating the bolt 70 to move the center member 66 in relation to the lifting plate 72. The bolt 70 can then be locked in position by tightening the locknuts 76, 76 against the lip 74.

The slide box 26 further comprises a drive cylinder 90, which is preferably a pneumatically driven cylinder of a type known to those skilled in the art. The cylinder 90 is mounted on one end to a wall of the slide box 26 and is mounted on the other end to the second lever 80. The cylinder 90 is driven by a controlled source of pressurized air (not shown) through one of the control lines 56 connected thereto. The control line 56 carrying the pressurized air is, in turn, controlled by the control unit 54, in a manner known to those skilled in the art. The cylinder 90 is operated to drive the second lever 80 forward, which, in turn, pivots about the third pin 86 and thus lifts the lifting plate 72 and, therefore, the suspension 24 upwardly. Likewise, when the cylinder 90 is driven in the other direction it lowers the lifting plate 72 and, therefore, the suspension 24 toward the work surface 16.

The suspension 24 further comprises two L-shaped legs 92,92, for supporting the steam iron 22. Each leg 92 is pivotally mounted on one end by a pin 94 to the free end of a respective leg 68 of the center member 64. The other end of each L-shaped leg 92 is pivotally mounted to one side of the steam iron 22, respectively, by another pin 96. The steam iron 22 therefore is suspended from the center member 64 by the L-shaped legs 92,92. However, as shown in FIG. 2, the pins 92,92 are preferably offset from the center of gravity of the steam iron 22 toward the rear of the steam iron or, that is, toward the side opposite the blow nozzle 52. Because the steam iron 22 is illustrated schematically as a rectangle in FIG. 2, the center of gravity would be at the center of the rectangle. Therefore, the pin 96 is mounted to the rear side of the rectangular center. As a result, when the steam iron 22 is suspended from the L-shaped legs 92, the front end of the steam iron where the blow nozzle 52 is located is biased under its own weight toward the work surface 16. As can be seen, because the steam iron 22 is pivotally mounted, the position of the blow nozzle 52 can be controlled to direct the stream of air and/or steam therefrom onto the seam 20, as will be described further below.

The suspension 24 further comprises an adjusting member, indicated generally as 98, for adjusting the degree to which the steam iron 22 is pivoted about the pins 96,96. The adjusting member 98 comprises a driving cylinder 100, which is preferably a pneumatically controlled cylinder of a type known to those skilled in the art. The cylinder 100 is connected to a source of pressurized air (not shown) by one of the control lines 56 which, in turn, is controlled by the control unit 54. The cylinder 100 is mounted to the inside of the center member 66 on one end thereof, adjacent to the bolt 70. The adjusting member 98 further comprises a positioning member 102 connected on one end to the driving end of the cylinder 100: A locking member 104 of the adjusting member is mounted on the other end of the positioning member 102.

Two shoulders 106,106 of the apparatus are each mounted to, and extend inwardly from each L-shaped leg 92,92, respectively. As shown in FIG. 2, the shoulders 106,106 abutt against the locking member 104 when the steam iron 22 is adjusted to a horizontal position. The adjusting member 98 further comprises two rocking levers 108,108, which are each generally U-shaped, as shown in FIG. 2. Each rocking lever 108 is pivotally mounted by a pin 110 near one end to a respective leg 68 of the center member 66. The other free end of each rocking lever 108 supports on an inside surface thereof a respective nub 112,112, of the steam iron 22. The nubs 112,112 are each mounted on either side of the steam iron 22, respectively.

In the operation of the suspension 24, when the cylinder 100 is driven downwardly toward the work surface 16, the positioning member 102 drives each rocking lever 108 to rotate about its respective pin 110 toward the rear of the steam iron 22. Each nub 112 of the steam iron therefore slides downwardly on the inside surface of the respective rocking lever 108 under the weight of the front end or the steam iron 22. As a result, the front end of the steam iron is rotated about the pins 96,96 toward the work surface 16. On the other hand, when the cylinder 100 is driven upwardly away from the work surface 16, the free ends of the rocking levers 108,108 are rotated toward the front end of the steam iron 22. The inside surfaces of the rocking levers 108,108 then push the nubs 112,112 upwardly and, therefore, the front end of the steam iron 22 away from the work surface 16. When the steam iron 22 is adjusted to a horizontal position, as shown in FIG. 2, the shoulders 106,106 of the legs 92,92 prevent the steam iron from rotating upwardly any further. Therefore, as can be seen, by controlling the cylinder 100, the angular position of the steam iron 22 relative to the work surface 16 can be accurately controlled. Likewise, by operating the cylinder 90, the vertical position of the suspension 24 and, therefore, the steam iron 22 can equally be controlled.

In operating the apparatus 10 to perform an ironing operation, the cylinder 100 is driven downwardly to orient the blow nozzle 52 toward the seam 20 of the fabric part 18. After blowing air and/or steam through the blow nozzle 52 over the length of the seam, as described above, the cylinder 90 is then operated to lower the steam iron 22 so that its bottom surface lays flat on the seam 20 and fabric part 18. The steam iron 22 is then passed over and against the seam 20 to iron the seam. The course of the steam iron 22 is controlled by appropriately driving the first and second drive pulleys 42 and 48, respectively, as described above. One advantage of the present invention is that because the steam iron 22 is pivotally mounted on the pins 96,96, if the fabric part 18 and/or seam 20 has a bump or elevation or, on the other hand, a depression therein, the steam iron 22 will pivot and adapt substantially to that contour to thoroughly iron the seam. Likewise, if the seam 20 is curved in the plane of the work surface 16, the drive pulleys 44,44 and 50,50 can be controlled to drive the steam iron 22 in a path that follows the contour of that seam.

Figure 3:
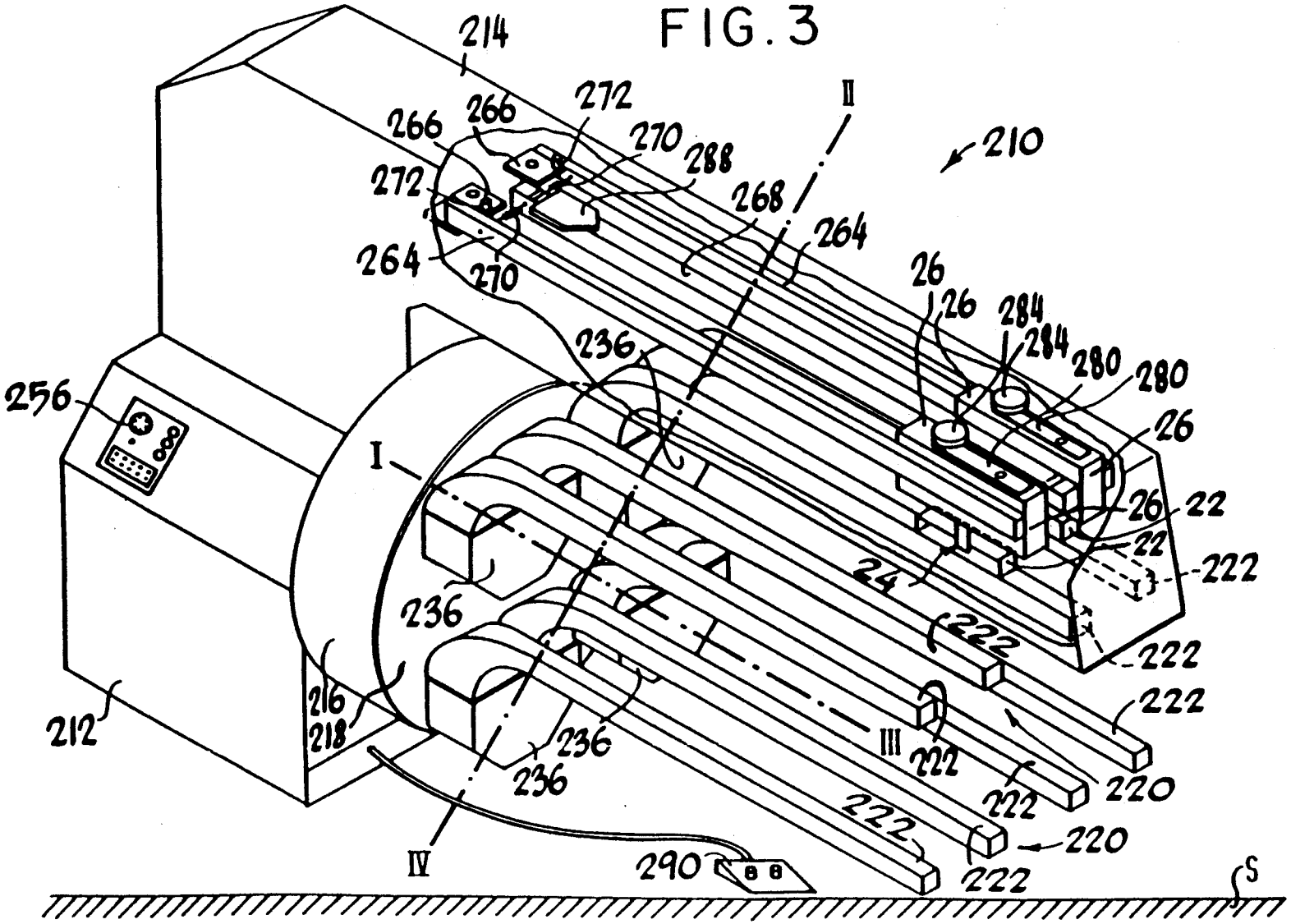
FIG. 3 is a perspective view illustrating schematically another embodiment of a seam ironing apparatus embodying the present invention.

FIG. 3 illustrates another seam ironing apparatus embodying the present invention indicated generally by the reference numeral 210. The apparatus 210 comprises several work areas for consecutively ironing different fabric parts or garments. The apparatus 210 comprises a stand 212 and a boom 214 mounted on top of the stand and projecting outwardly therefrom. The stand 212 is mounted on a surface defined by a plane indicated generally as S. The apparatus 210 further comprises a generally cylindrical shaped air chamber 216, mounted on one side of the stand 212 and underneath the boom 214. The air chamber 216 defines an end wall 217 which is located opposite the side of the chamber mounted to the stand 212. A circular cover plate 218 of the apparatus is rotatably mounted to the air chamber 216 over the end wall 217 on a shaft (not shown) in a manner known to those skilled in the art.

The apparatus 210 further comprises four ironing bar assemblies, each indicated generally by the reference numeral 220. Each ironing bar assembly 220 comprises two substantially axially elongated ironing bars 222,222, which are each mounted on one end thereof to the cover plate 218. As shown in FIG. 3, each pair of ironing bars 222,222 are mounted in parallel relationship to each other, and project outwardly from the cover plate 218 and parallel to the axis of the boom 214. The four ironing bar assemblies 220,220 are, in turn, mounted on the cover plate 218 on a diameter concentric with the axis of rotation of the cover plate and are each spaced about 90° apart from the next one.

Figure 4:
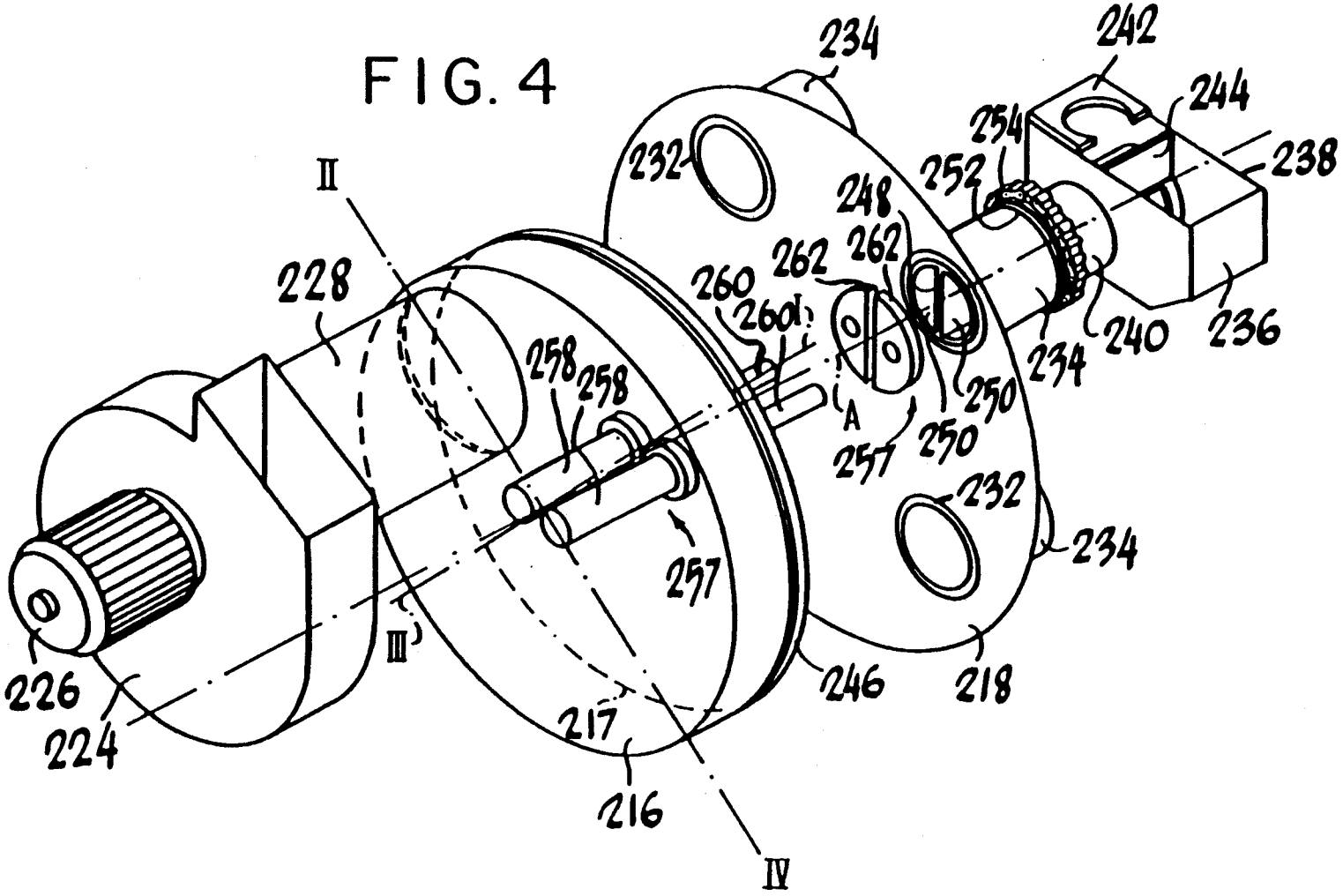
FIG. 4 is an exploded perspective view of part of the apparatus of FIG. 3 showing in further detail the blower, air chamber, and cover plate of the apparatus.

Turning to FIG. 4, part of the apparatus 210, and in particular the air chamber 216 and cover plate 218, are shown in further detail. The apparatus 210 further comprises a blower 224 driven by a motor 226, which are both mounted inside the stand 212. The blower 224 is connected to the air chamber 216 by an air conduit 228. The air conduit 228 is mounted on one end to the blower 224 and is mounted on the other end to the air chamber 216. The blower 224 therefore sucks air from the air chamber 216 through the air conduit 228. As shown in FIG. 4, the cover plate 218 is rotatably mounted to the air chamber 216 about an axis of rotation A extending therethrough. The axis of rotation A extends through the center of the cover plate 218 and air chamber 216, and is substantially parallel to the lengthwise axis of the boom 214, shown in FIG. 3.

The cover plate 218 has defined therein four air flow apertures 232,232 which each extend through the cover plate and are each spaced about 90° apart from the next one on a diameter concentric with the axis of rotation A. The apparatus 210 further comprises four substantially cylindrical shaped air flow pipes 234,234, which are each rotatably mounted on one end to the cover plate 218 over each of the air flow apertures 232,232, respectively. The apparatus 210 further comprises four air distribution boxes 236,236, each of which are mounted on one side thereof to the other end of one of the respective air flow pipes 234,234, respectively. Only one air distribution box is shown in FIG. 4 and, as can be seen, it is generally cup-shaped and defines a substantially rectangular opening 238 in the top thereof. Each box 236 further defines in the side wall thereof facing the cover plate 218, an aperture 240 dimensioned to fit therethrough the other end of a respective air pipe 234. Each box 236 is thus mounted to the cover plate 218 by fixedly mounting one end of a respective air pipe 234 through its aperture 240.

As shown in FIG. 3, each box 236 has mounted therein one ironing bar assembly 220. The two ends of each ironing bar 222,222 are mounted in a respective box 236 through the aperture 238 in the top thereof. Each box 236 further comprises two C-shaped clamps 242,242 (only one shown), and an air separation panel 244 that divides the interior space of the box substantially into halves. The clamps 242 are each dimensioned to fit over the end of the respective ironing bar 222, and, therefore, secure the respective ironing bar in place therein. Each separation panel 244 is dimensioned to fit between the ironing bars to direct the air flow from the blower 224 through the separate ironing bars, as will be described in further detail below. One advantage of the present invention is that because the ironing bars 222,222 are simply mounted in the boxes 236,236, different shaped or dimensioned ironing bars can easily be interchanged with those shown in FIG. 3 if, depending upon the type of fabric part to be ironed, a different shaped ironing bar is required.

The apparatus 210 further comprises an elastic seal ring 246 mounted between the air chamber 216 and cover plate 218. Therefore, the cover plate 218 is rotatable with respect to the air chamber 216 without causing a noticeable amount of air leakage therebetween. The apparatus 210 further comprises four separation panels 248,248, which are each mounted inside a respective air pipe 234. As shown in FIG. 4, each separation panel 248 divides the interior space of its respective air pipe 234 into two separate air flow channels 250,250. Each panel 248 is mounted in substantially the same plane as the respective panel 244 in the adjacent box 236, as shown in FIG. 4. As a result, each air flow channel 250,250 extends through the respective side of the panel 244 and into the respective box 236 in order to draw air through the respective ironing bar 222 mounted therein, as will be described further below. Preferably, each ironing bar 220 has formed in the top surface thereof a plurality of apertures (not shown) that are in fluid communication with the respective air flow channel 250. Therefore, when the blower 224 sucks air through the air chamber 216, the air is, in turn, drawn through the air channels 250,250 and through the top surface of the ironing bars 220,220. Thus, by operating the blower 224, the suction on the top surface of the ironing bars can be accurately controlled.

The apparatus 210 further comprises guide means to ensure that the top flat surface of each ironing bar 222,222 is oriented substantially parallel to the base plane S of the stand 212, regardless of the rotational position of the cover plate 218. The guide means comprises four gear members 252,252, each of which are fixedly mounted over a respective air pipe 234, as shown in FIG. 4. The guide means further comprises a chain 254 which is drivingly connected to each gear member 252. The chain 254 is, in turn, driven by a motor (not shown) to rotate the respective air pipes 234,234 about their own axis of rotation and, therefore, the respective ironing bar assemblies 220,220, relative to the cover plate 218.

The apparatus 210 further comprises a control unit, indicated generally as 256, which may be substantially the same as the control unit 54 described above in relation to the previous embodiment. The control unit 256 is preferably electrically connected to the motor driving the chain 254 to control the operation thereof. Therefore, when the cover plate 218 is rotated in one direction, the chain 254 is driven to rotate the air pipes 234,234 and, therefore, the ironing bar assemblies 220,220 about their own axes of rotation in the opposite direction. Accordingly, the rotation of the chain 254 can be accurately controlled to ensure that the ironing bar assemblies are rotated so that the top of each ironing bar 222,222 is oriented in a plane substantially parallel to the plane S, regardless of the position of the cover plate 218. The apparatus 210 operates so that the cover plate 218 is rotated about the axis of rotation A in 90° steps. For example, four possible step positions, each spaced about 90° apart from the next one, are indicated in FIGS. 3 and 4 as I, II, III and IV, respectively. The cover plate 218 may be rotatably driven by a stepping mechanism (not shown) of a type known to those skilled in the art. The stepping mechanism is preferably driven, for example, by pneumatic cylinders and its operation can be controlled by the control unit 256. The cover plate 218 therefore is rotatably driven so that at any one time after the plate 218 is rotated one 90° step, one of the ironing bar assemblies 220 is positioned in step position II, as shown in FIG. 3, which is immediately below the boom 214 and oriented in a parallel relationship thereto.

The apparatus 210 further comprises a valve assembly 257 including two air duct valve drives 258,258 which are each preferably pneumatic cylinders, of a type known to those skilled in the art, mounted in the end wall 217 of the air chamber 216. The pneumatic cylinders of the valve drives 258,258 are controlled by a control line connected to a source of pressurized air (not shown) which, in turn, is controlled by the control unit 256 in a manner known to those skilled in the art. Each valve drive 258 has mounted on the end thereof facing the cover plate 218 a setting element 260, also of a type known to those skilled in the art. The free end of each setting element 260,260 is drivable for closing one side of a lock disk 262, which, in turn, closes the respective air channel 250 positioned in front thereof. The lock disk 262 comprises two semicircular shaped sides which are each connectable, respectively, to one end of a respective setting element 260. The two valve drives 258,258 are positioned in the wall 217 of the air chamber 216 to be axially aligned with a respective air pipe 234 and, therefore, ironing bar assembly 220, located in step position I. The valve drives 258,258 therefore are operated to control the air flow through the respective air flow channels 250,250 of the respective air pipe 234. As can be seen, the suction through each ironing bar 222, 222 located in step position I can be controlled by operating the valve drives 258,258.

It will be understood that it is equally possible to provide a pair of valve drives 258,258 mounted in the end wall 217 of the air chamber 216 for each respective air duct 234. Therefore, if necessary, a valve drive is provided at each of the four respective step positions I through IV. In the embodiment of the present invention shown in FIGS. 3 and 4, the apparatus 210 is particularly suitable for ironing trouser seams. Therefore, here it is only necessary to provide the valve drives 258,258 for the ironing bar assembly 220 located in the step position I. The valve drives 258,258 therefore are controllable to permit air to be drawn through the air pipe 234 and thus the ironing bars 222,222 located in step position I. In the apparatus 210, an aperture (not shown) is formed in the end wall 217 adjacent to the air conduit 228 in the location of step position II. Therefore, when the blower 224 is running, air is sucked by the blower through the ironing bars 222,222 located in step position II to hold the trousers or other garment thereon. However, the other air pipes 234,234 located in step positions III and IV abutt against the end wall 217 of the air chamber 216 and, therefore, cannot draw any air therethrough. Accordingly, there is no suction through the ironing bar assemblies 220,220 located in step positions III and IV. However, it will be understood that additional apertures may equally be formed in the end wall 217 of the air chamber 216 in the location of the step positions III and IV, if it is desired to have suction through the ironing bars in those step positions.

The apparatus 210 further comprises a slide box and steam iron assembly mounted inside the boom 214, which is substantially the same as the slide box and steam iron assembly illustrated in FIGS. 1 and 2 and described above in relation to the previous embodiment. Therefore, in describing the apparats 210 like numbers are used to indicate like elements and reference is made to FIG. 2 in describing the slide box and steam iron shown in FIG. 3.

As shown in FIG. 3, the apparatus 210 comprises two slide boxes 26,26, each having a steam iron 22,22 suspended therefrom by a respective suspension 24. The apparatus 210 further comprises two outside guide rails 264,264 which are each substantially the same as the guide rails 28,28 described above in relation to FIG. 1. The guide rails 264,264 are mounted in parallel relationship to each other in the lengthwise direction of the boom 214, for rotatably mounting on each inside surface thereof one of the respective slide boxes 26,26, respectively. Each guide rail 264 is mounted on one end thereof to the boom 214 by a pivot bearing 266,266, respectively. Each guide rail 264, therefore, can pivot about its respective pivot bearing 266 in a plane substantially parallel to the plane of the top surface of each ironing bar 220,220 mounted therebelow.

The apparatus 210 further comprises a substantially elongated beam 268. The beam 268 is mounted on one end between the guide rails 264,264 adjacent to the pivot bearings 266,266, and projects outwardly therefrom between the guide rails. The apparatus 210 further comprises two springs 270,270. Each spring 270 is connected on one end to one side of the beam 268 and is connected on the other end to an inside surface of the guide rails 264,264, respectively, so that both springs 270,270 bias the outside guide rails 264,264 inwardly toward the beam 268. Therefore, if one of the guide rails 264,264 is pivoted outwardly, the respective spring 270 will be stretched and thus act to pull the guide rail back toward its initial position. The apparatus 210 further comprises two stops 272,272, each of which are mounted adjacent to one of the pivot bearings 266,266, respectively. Each stop 272 therefore abutts against the respective guide rail 264 to prevent the guide rail from being pulled inwardly any further by its respective spring 270. The beam 268 is provided, for example, for mounting control lines (not shown) for carrying electric current, pressurized air and/or steam to the two slide boxes 26,26 and their respective steam irons 22,22.

Each of the two slide boxes 26,26 are preferably driven along the guide rails 264,264 by a slide box drive (not shown) that is substantially the same as the slide box drive 38 described above in relation to the previous embodiment. Likewise, the slide box drives are preferably electrically connected to the control unit 256 so that the movement and position of each slide box can be accurately controlled.

Turning again to FIG. 2, each slide box 26 of the apparatus 210 comprises in addition to the components of the slide box described above in relation to the previous embodiment, driving means for laterally moving each slide box 26. The driving means comprises a drive cylinder 274 mounted on one end thereof to an inside wall of the slide box adjacent to the top thereof. The drive cylinder 274 is preferably pneumatically driven from a source of pressurized air through a control line (not shown). The driving end of the cylinder 274 is mounted to a connecting member 276. The connecting member 276 has mounted therethrough one end of a drive pin 278 which is mounted substantially perpendicular to the axis of the drive cylinder 274. The other end of the drive pin 278 extends upwardly over the top of the slide box 26 and is rotatably mounted through one end of a pivot arm 280. The pivot arm 280 is rotatably mounted on an inside portion thereof to a journal 282 fitted therethrough. The journal 282 is, in turn, mounted on its other end to a top wall of the slide box 26. The other end of the pivot arm 280 has mounted thereon a guide roller 284 that is rotatably mounted on a shaft 286, which is axially oriented substantially perpendicular to the plane of the guide arm 280. The drive cylinders 274,274 are preferably operatively controlled by the control unit 256, in a manner known to those skilled in the art. Therefore, each slide box 26 can be controllably moved laterally relative to the beam 268, in order to iron a curved seam, as will be described in further detail below.

The apparatus 210 further comprises one or more guide templates mounted to the top of the beam 268, shown typically as 288 in FIG. 3. The template 288 is formed substantially in the shape of a wedge, however, it may take a different shape if required to move the slide boxes 26,26 in a different manner. The template 288 is mounted near the inside end of beam 268. Therefore, when one of the slide boxes 26,26 is moved toward the pivot bearing 266 of its respective guide rail 264, the guide roller 284 contacts the template and is pushed outwardly therefrom. Accordingly, the rail 26 pivots about its respective pivot bearing 266 and, therefore, the slide box 26 and steam iron 22 follow the same path. The wedge-shaped template 288 shown in FIG. 3 is particularly suitable for ironing trouser seams. The seam in the area of the trouser seat, which generally extends outwardly, is fitted over the bar 220 adjacent to the template 288. The template 288 therefore forces the slide box 26 and the steam iron 22 to follow the path of the seam in the seat of the trousers. As will be recognized, different shaped templates can be mounted on specific points of the beam 268 in order to move the steam irons 22,22 along the path defined by any such differently shaped seam.

The apparatus 210 further comprises a pedal 290 electrically connected to the control unit 256 which, in turn, is connected to the valve drives 258,258 to control the operation thereof. Therefore, an operator can simply operate the pedal 290 to actuate the valve drives 258,258 which, in turn, control the air flow through the air pipe 234 and the ironing bar assembly 220 rotated into the step position I in front thereof.

In operating the apparatus 210, a fabric part or garment, such as a pair of trousers, is fitted over the ironing bar assembly 220 located in the step position I. The trousers are fitted over the ironing bars 222,222 so that a trouser seam is oriented on the top surface of each ironing bar. The operator then opens the edges of the fabric adjacent to the trouser seams outwardly, starting with the ends of the seams near the free end of the ironing bars. The operator then turns on the blower 224 to suck air through the air chamber 216. The suction through the ironing bar assembly located in step position I can be controlled by actuating the pedal 290. As described above, the suction through each ironing bar 222,222 located in step position I is controllable by operating the respective valve drive 258,258. For example, by controlling the valve drives 258,258 to pull the disk 262 away from the adjacent air pipe 234, air is then sucked by the blower 224 from the ironing bars 222,222, through the channels 250,250 located in step position I.

After the trousers are properly oriented, the cover plate 218 is then rotated 90 so that the ironing bar assembly 220 carrying the trousers is moved into step position II. The chain 254 of the apparatus is simultaneously driven to rotate each air pipe 234 and, therefore, each ironing bar assembly 222 about their own axes in the opposite direction, to ensure that the top surfaces of the ironing bars are maintained substantially parallel to the plane S. Each slide box 26 is then operated by the control unit 256 to iron the trouser seams fitted over the ironing bars 222,222 in step position II, in the same manner as described above in relation to the previous embodiment for ironing the seam 20.

When the trousers are moved from step position I to step position II, another pair of trousers can then be placed on the ironing bar assembly 220 moved into step position I in the same manner as described above. Again, each trouser seam is oriented on top of each respective ironing bar 222,222, and the operator spreads the edges of the fabric adjacent to the seams outwardly. The operator again actuates the valve drives 258,258 to suck air through the ironing bars in step position I. After the trousers in step position II are ironed, the cover plate 218 is rotated another 90° so that the ironed trousers are moved into step position III. In step positions III and IV, the suction through the ironing bar assemblies 220,220 is cut-off by the end wall 217 of the air chamber 216.

As can be seen, after the first four rotational steps of the cover 218, each ironing bar assembly 220 can have a pair of trousers mounted thereon. Then, during the next four consecutive steps, new trousers are not usually placed on the ironing bar assemblies, but the second trouser seam of each pair of trousers is then properly positioned on the top of each ironing bar to be ironed in the same manner as described above. Once the first pair of trousers has been rotated through the ironing cycle twice, the trousers may then be removed from the ironing bars when it reaches the step position I. New trousers may then be consecutively placed thereon to be ironed in the same manner as described above.

What is claimed is:

1. An ironing apparatus comprising:

a frame;

a rotatably driven plate mounted to said frame;

at least four air pipes rotatably mounted to said plate;

at least four air distribution boxes, each of said air distribution boxes being mounted to a respective air pipe;

at least four axially elongated ironing bars, each of said ironing bars being mounted to a respective air distribution box and projecting outwardly therefrom for supporting a fabric part thereon;

a blower coupled in fluid communication with at least one of said ironing bars for drawing air through said ironing bar for holding a fabric part supported thereon;

positioning means coupled to each of said ironing bars for rotating said ironing bars upon rotation of said plate, for controlling the orientation of the surfaces of said ironing bars;

at least one guide rail mounted to said frame and projecting outwardly therefrom above said ironing bars;

at least one slide box coupled to said guide rail and slidable in relation thereto; and at least one ironing member suspended from said slide box for ironing a fabric part supported on at least one of said ironing bars.

2. An ironing apparatus as defined in claim 1, wherein said apparatus comprises eight of said ironing bars, wherein each of said air distribution boxes has mounted therein one pair of said ironing bars.

3. An ironing apparatus as defined in claim 1, wherein said positioning means comprises:

at least four gear members, each of said gear members being mounted to a respective air pipe; and at least one chain coupled to said at least four gear members for rotating said gear members and, therefore, said air pipes for controlling the orientation of said ironing bars.

4. An apparatus for ironing comprising:

a rotatably driven support plate;

a plurality of axially elongated fabric support members mounted to the support plate in pairs, each pair of support members being spaced relative to a next pair on the support plate and projecting outwardly therefrom for supporting a separate fabric part thereon;

a vacuum unit coupled to at lest one pair of support members for drawing air through the support members to maintain a fabric part to be ironed in a substantially fixed position thereon;

at least one guide member supported above the support plate and oriented in a substantially parallel relationship with each pair of support members;

at least one ironing member supported by the guide member and moveable along the guide member to iron a fabric part supported on the pair of support members located immediately below the guide member in an ironing position, the support member being adapted to be rotatably driven to successively move each pair of support members and, thus, each fabric part supported thereon into the ironing position to be ironed by the ironing member; and means for adjusting the position of each pair of support members relative to the ironing member to facilitate uniform contact of the ironing member with the fabric part supported on the respective pair of support members.

5. An apparatus as defined in claim 4, wherein the vacuum member is successively coupled in fluid communication with each pair of support members when the respective pair of support members is located in the ironing position.

6. An apparatus as defined in claim 4, wherein the means for adjusting includes at least one drive unit coupled to each pair of support members for rotating each respective pair of support members relative to the support plate to adjust the position of the respective pair of support members relative to the ironing member.

7. An apparatus as defined n claim 6, wherein the drive unit includes a plurality of gear members, each gear member being coupled to a respective pair of support members, and at least one drive belt coupled to the gear members, to rotatably drive the gear members and, in turn, rotatably drive the pairs of support members relative to the support plate to adjust the position of each pair of support members relative to the ironing member.

* * * * *

UNITED STATES PATENT AND TRADEMARK OFFICE

CERTIFICATE OF CORRECTION

PATENT NO. : 5 054 218

DATED : October 08, 1991

INVENTOR(S) : Dieter MAI

It is certified that error appears in the above-identified patent and that said Letters Patent is hereby corrected as shown below:

In column 14, line 4, change "...90..." to read --...90°...--;

in column 15, line 1, change "...said slide..." to read --...said at least one slide...--;

in column 16, line 3, delete "...adapted to be...";

in column 16, line 24, change "...n..." to read --...in...--.

Signed and Sealed this

Sixth Day of April, 1993

*Attest:*

STEPHEN G. KUNIN

*Attesting Officer*

*Acting Commissioner of Patents and Trademarks*